US005388796A

United States Patent [19]

Sullivan

[11] Patent Number: 5,388,796

[45] Date of Patent: Feb. 14, 1995

[54] STANDARD AND BRACKET SUPPORT SYSTEM

[75] Inventor: Lloyd Sullivan, Seattle, Wash.

[73] Assignee: Phoenix Display Corporation, Kent, Wash.

[21] Appl. No.: 928,957

[22] Filed: Aug. 12, 1992

[51] Int. Cl.[6] ..... A47G 29/02

[52] U.S. Cl. ..... 248/246; 748/222.2; 748/297.2; 108/108

[58] Field of Search ..... 248/243–246, 248/235, 297.2, 222.2; 108/108

[56] References Cited

U.S. PATENT DOCUMENTS

| | | | |
|---|---|---|---|
| 723,677 | 3/1903 | Kade . | |
| 1,219,158 | 3/1917 | Rose . | |
| 1,276,677 | 8/1918 | Mittleburg . | |
| 2,005,593 | 6/1935 | Onions et al. . | |
| 2,252,997 | 8/1941 | Vanderveld . | |
| 2,639,817 | 5/1953 | Ehret . | |
| 2,703,692 | 3/1955 | Felix . | |
| 2,703,693 | 3/1955 | Cropanese . | |
| 3,080,980 | 3/1963 | Gibbons . | |
| 3,111,916 | 11/1963 | Bjerke . | |
| 3,158,349 | 11/1964 | Bergstrom . | |
| 3,225,720 | 12/1965 | Maslow . | |
| 3,242,886 | 3/1966 | Chesley . | |
| 3,355,134 | 11/1967 | Chesley . | |
| 3,429,540 | 2/1969 | Worrallo . | |
| 3,710,734 | 1/1973 | Bofferding et al. . | |
| 3,810,430 | 5/1974 | Siegal . | |
| 3,865,337 | 2/1975 | Towfigh et al. . | |
| 4,033,540 | 7/1977 | Hamblin . | |
| 4,077,522 | 3/1978 | Trubiano . | |
| 4,102,275 | 7/1978 | Spound et al. . | |
| 4,103,855 | 8/1978 | Grosse . | |
| 4,156,515 | 5/1979 | Mochly . | |
| 4,170,335 | 10/1979 | King | 248/246 |
| 4,174,486 | 11/1979 | Winkler . | |
| 4,223,863 | 9/1980 | Birman . | |
| 4,299,368 | 11/1981 | Winkler | 248/246 |
| 4,335,861 | 6/1982 | Klaric . | |
| 4,421,289 | 12/1983 | Sturm . | |
| 4,534,529 | 8/1985 | Dorner . | |
| 4,603,782 | 8/1986 | Fenwick . | |
| 4,609,172 | 9/1986 | Dorner . | |
| 4,671,481 | 6/1987 | Beard . | |
| 4,724,614 | 6/1981 | Worrallo . | |
| 4,901,965 | 2/1990 | Bowman | 248/246 |
| 5,063,715 | 11/1991 | Goodman . | |

FOREIGN PATENT DOCUMENTS

| | | | |
|---|---|---|---|
| 2102834 | 7/1971 | Germany | 248/246 |
| 1560724 | 2/1980 | United Kingdom | 248/246 |

OTHER PUBLICATIONS

"Rakks, Price List", *Rangine Corporation.*

*Primary Examiner*—Alvin C. Chin-Shue

[57] ABSTRACT

A standard and bracket support system having continuous adjustability to an infinite number of bracket positions is provided. The standard portion includes an elongated standard having opposed front and back walls with a slot through the front wall. The bracket has a heel portion coupled to a transverse plate. The plate has a length larger than the front-to-back interior depth of the standard. The bracket can be tilted upward, positioning the plate at an angle in the interior of the standard to permit free movement along the length of the standard, with the bracket arm extending through the slot. When the desired position is reached, the bracket is pivoted towards a locked configuration. The excess length of the plate causes elastic deformation of the standard walls. The plate moves from an upward angle configuration through a horizontal configuration, causing maximum standard deformation and to a downward angle configuration determined by a stop device such as the heel bottom of the bracket. In the locked configuration the plate is in contact with and compressed between opposed interior surfaces of the standard. The compression of the plate develops substantially sufficient frictional forces to maintain the bracket in the desired location. Maintenance of bracket position is achieved substantially without plastic deformation of the components, without gouging, punch-through or deforming of the standard. The edge of the plate which contacts the back surface of the standard is wider than the thickness of the plate and distributes the compression force over a effective width which is wider than bracket thickness.

20 Claims, 11 Drawing Sheets

STANDARD AND BRACKET SUPPORT SYSTEM

The present invention relates to a standard and bracket support system for supporting items such as shelves, displays, clothes hanger rods and the like, and particularly to a standard and bracket system that is economical to produce and yields continuous, rather than discrete, height adjustability.

BACKGROUND OF THE INVENTION

Many previous systems for supporting shelving, display items, clothes hanger rods and the like have provided for shelf support at discrete heights so that the user cannot select the support height in a continuous fashion. Early efforts to provide for a continuous support system have been unsatisfactory for a number of reasons, including a comparatively high expense of such systems. U.S. Pat. No. 2,703,692, issued Mar. 8, 1955 to Felix discloses a system of uprights and supporting arms intended to permit setting the supporting arm at a required height. The supporting arms of Felix had a side projection which is believed to make it impractical to produce by a stamping operation. More complicated production techniques contribute to the expense of the device. Felix provided for a point on the heel portion of the support for penetrating into the back wall of the upright. Such deformation of the back wall can provide an unsightly device, particularly when a high-finish system is required. The deformation also detracts from infinite adjustability since, whenever the point is positioned sufficiently near a previously formed depression, the pre-existing depression will tend to guide the point of the support away from the desired location, preventing the user from readjusting a shelf to a location close to the original location. Felix provided for a cam action, but considered it necessary to combine this with a wedge device and a point device, and disclosed using the combination of all three to achieve the necessary support.

U.S. Pat. No. 3,865,337 issued Feb. 11, 1975 to Towfigh, et al. discloses a standard and bracket system with a pin secured to the bracket. In the system of Towfigh, a portion of the bracket body is used in maintaining the bracket at the desired height. In particular, a portion of the bracket (the portion between the pin and the back surface) is compressed within the standard. The back surface of the bracket is pressed against the back wall of the standard so that the thickness of the bracket body determines the portion of the back wall over which the clamping pressure is distributed.

Commercial systems employing a pin and bracket system have been found to have relatively high costs, at least partly since a thick bracket body (e.g., ¼ in. or more) is needed to distribute clamping force over the standard back wall sufficiently to avoid punch-through or rupture of the back wall. This configuration also requires a relatively wide slot to accommodate the wide bracket body. High forces are concentrated on the pin-bracket junction both because of the high clamping forces and the fact that the pin-body junction is a primary component for resisting lateral wobbling of the bracket. The high forces are believed to contribute to enlargement of the pin hole. Attempts to enhance support by employing softer materials such as aluminum (e.g., to provide bearing support as a supplement to friction support) may reduce the bracket lifetime because of the high forces between the pin and the soft metal body. Use of metals such as aluminum for the standard portion of the device result in plastic deformation of the standard leaving gouges or detents in the back wall (which are highly visible because of the wide slot required) and in the front wall (which partially convert the device from a friction clamp to a bearing device). Creation of plastic deformation is enhanced by providing a pin location (with respect to the bracket back surface) which exceeds the standard depth by about 0.02 inches (about 0.5 mm) or more. Formation of gouges or detents limits the continuous nature of the height adjustability since the bracket tends to move to a previously formed detent if an attempt is made to position the bracket near a previous detent.

Accordingly, it would be useful to provide a support system which has continuous height adjustment, is easily manufactured such as by roll forming and/or stamping, and avoids or minimizes gouging or other plastic deformation of components. In one embodiment, previously-available, off-the-shelf steel tubing can be used for the standards.

SUMMARY OF THE INVENTION

The present invention includes a standard and bracket system in which the heel portion of the bracket is coupled to a transverse plate. The transverse plate has a length slightly greater than the front-to-back interior spacing of the standard, when the standard is in an unstressed condition. The transverse plate fits easily into the interior of the standard when the bracket is tilted in a first non-locked position. Moving the bracket towards a locked position causes the plate to bear against opposed interior surfaces of the standard. As the plate approaches and passes through a configuration in which it is orthogonal to the axis of the standard, the standard slightly deforms to accommodate the plate. After passing through the orthogonal position, the plate is stopped at a slight angle to the axis of the standard, e.g., by contact of the bracket heel bottom with an interior surface of the standard. In this position, the standard is slightly elastically deformed and provides sufficient compression on the plate, accompanied by contact with the bottom portion of the heel, to achieve the desired support.

The rear edge of the plate is wider than the thickness of the bracket so that the clamping force is distributed over a width of the standard which is greater than the width of the bracket, thus minimizing or preventing plastic deformation or punch-through. The over-center locked position provides a predetermined or reproducible amount of friction force and provides the user with a tactile feedback, assuring the user of proper positioning of the bracket.

Aside from slight compression at the heel bottom of the bracket (acting as a stop), substantially all compression imparted by the elastically deformed standard is borne by the transverse plate. Because the plate bears against a relatively wide region of the opposed standard faces, the transverse plate can act to stabilize the bracket body against lateral wobble.

Since substantial compression of the bracket body is not needed for clamping the bracket or for lateral stabilization, and because the width of the bracket does not determine the resistance to deformation or punch-through, the bracket body can be relatively thin and can be produced by a standard stamping operation, thus providing for an economically feasible device.

DESCRIPTION OF THE PREFERRED EMBODIMENTS

Figure 1:
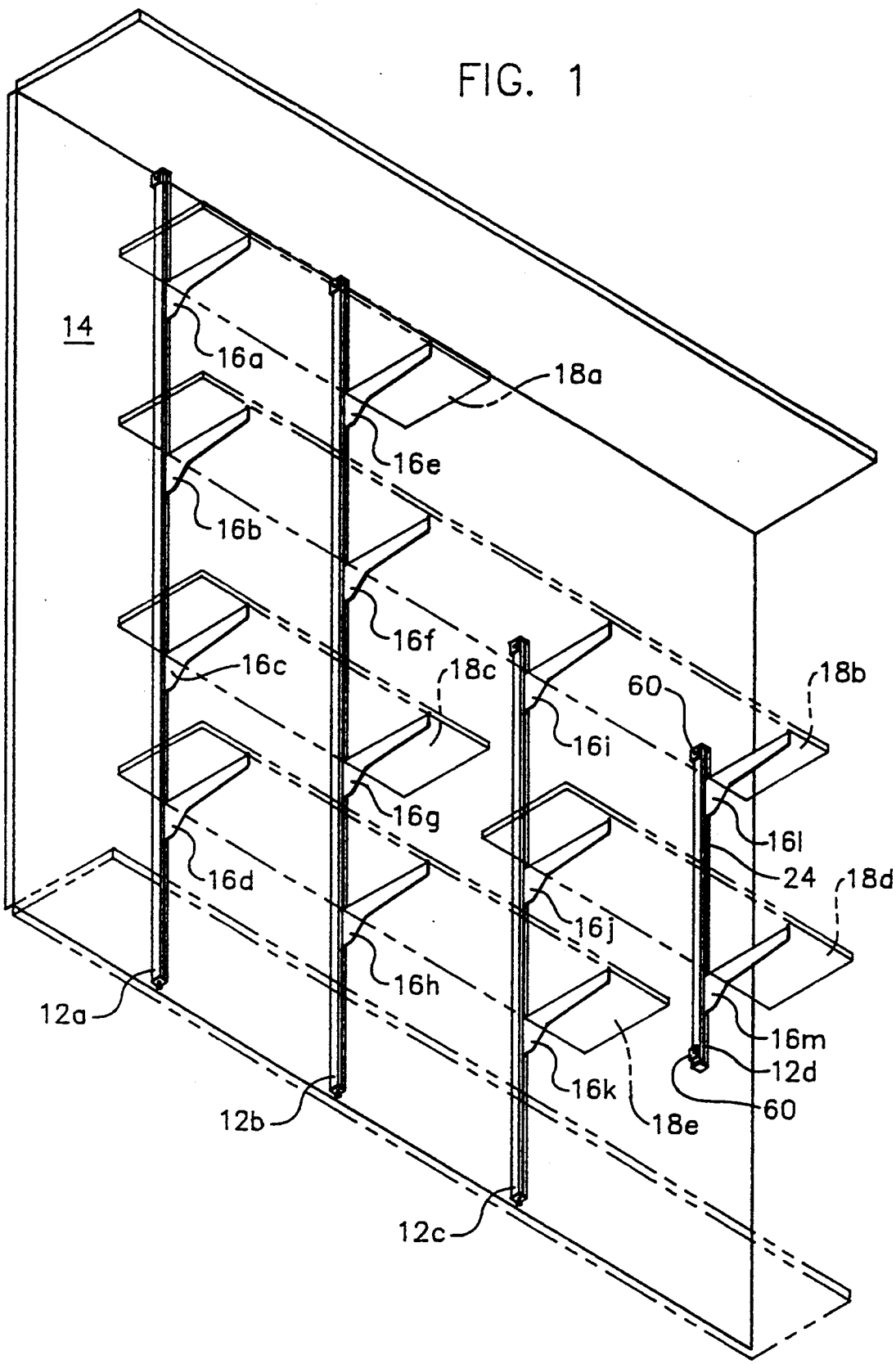
FIG. 1 is a perspective view of an installed bracket and standard system according to an embodiment of the present invention.

As depicted in FIG. 1, one or more standards 12*a*, 12*b*, 12*c*, 12*d* are attached to a wall 14 in a manner described more fully below. Each of the standards 12 can be engaged with one or more brackets 16*a*–16*m*. In the embodiment depicted in FIG. 1, the brackets 16 in the depicted locked configuration have horizontal upper surfaces which can be used, e.g., for supporting items such as shelves 18*a*–18*e*. The brackets 16 can have other configurations for supporting other types of structures, some examples of which are described below.

Figures 2, 4:
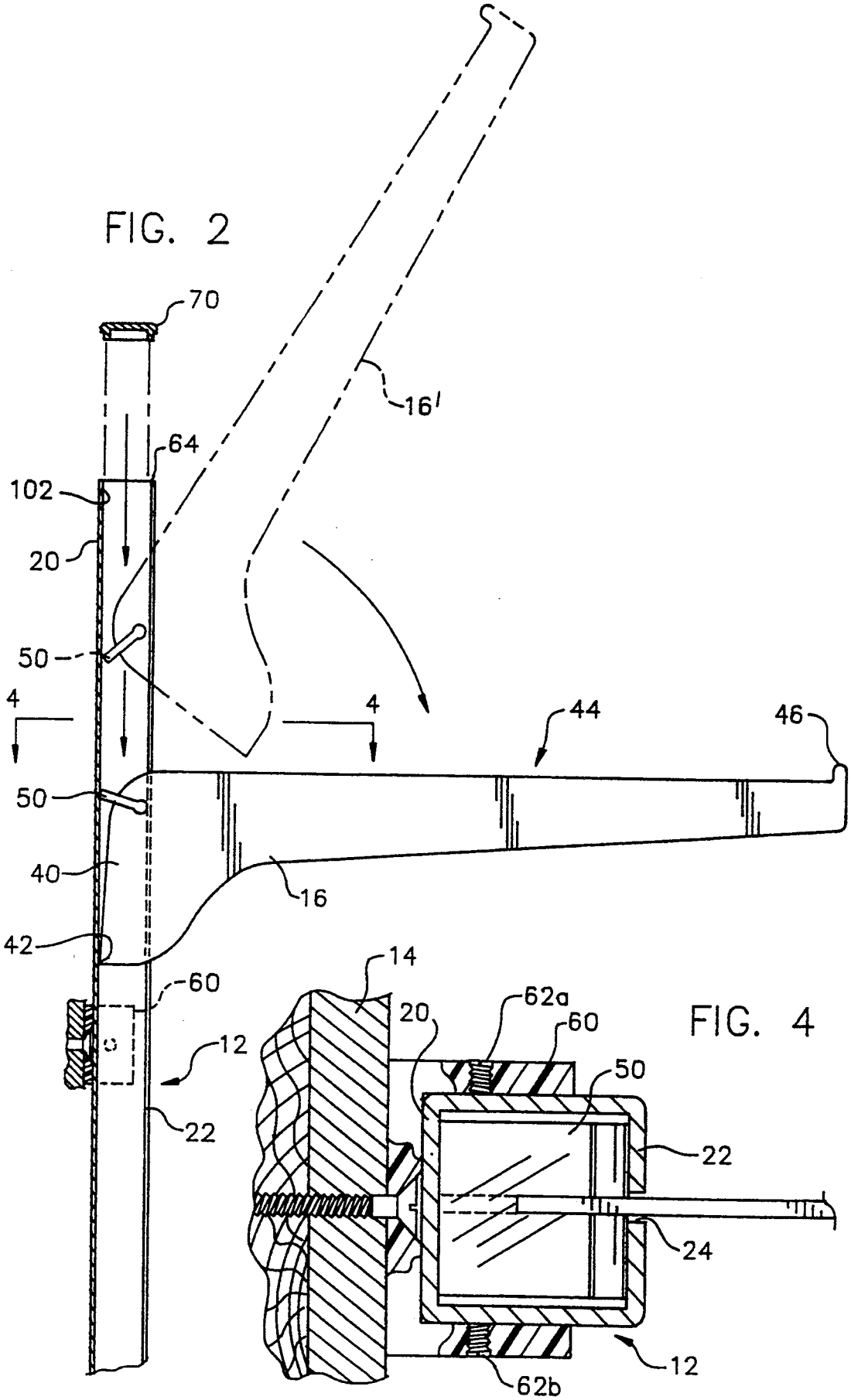
FIG. 2 is a partially exploded partial cross-sectional view of a standard and bracket system according to an embodiment of the invention, showing a bracket in a locked position and depicting an unlocked position in phantom.
FIG. 4 is a cross-sectional view taken along line 4—4 of FIG. 2.
Figure 2A:
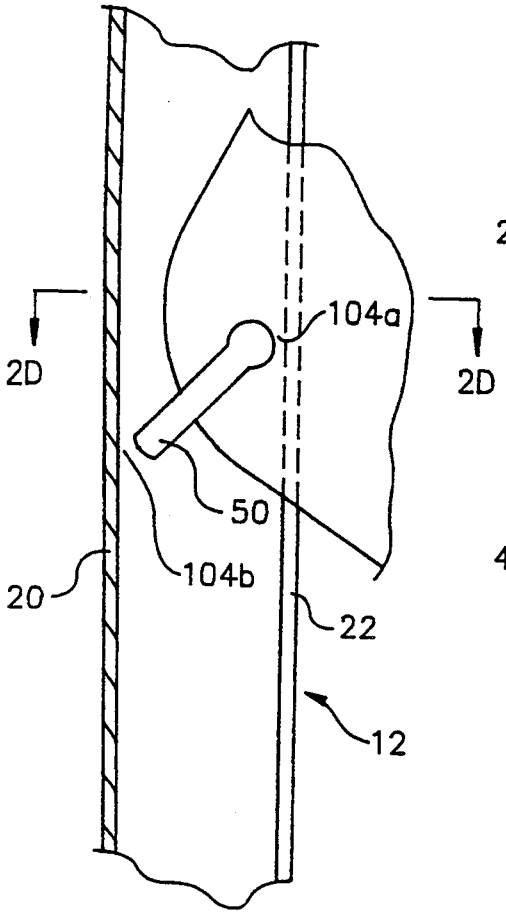
FIGS. 2A, 2B and 2C show a detail of the embodiment of FIG. 2 with three configurations of the bracket during a locking operation.

In the embodiment depicted in FIG. 2, the standard 12 includes a back wall 20 and a front wall 22. A slot 24 is formed over at least a part of the length of the front wall. As seen in FIG. 2D, according to one embodiment of the invention, the standard 12 in an unstressed condition has an exterior width 26 and exterior depth 28 of about 0.75 inches (about 2 cm). The interior width of the back wall 30 and sidewall 32 is approximately $\frac{5}{8}$ in. (about 1.5 cm). In the depicted embodiment, the thickness 34 of the bracket 18 is about 1/16 in. (about 1.5 mm) and the width 36 of the slot 24 is about $\frac{1}{8}$ in. (about 3 mm). Variations on the standard and bracket dimensions can be used as well, as will be apparent to those skilled in the art. The standards and brackets can be made from a number of materials. Preferably, steel is used, although it is also possible to use other metals, composites, resins, plastics, fiberglass and the like provided the necessary resiliency and clamping force is achieved. In the embodiment depicted in FIG. 2, the bracket 16 is a substantially planar member having an arm region 44 and a heel region 40 terminating in a heel bottom 42. If desired, the arm region 44 can include a lip 46 for engaging with an edge or slot in a shelf.

Figure 8:
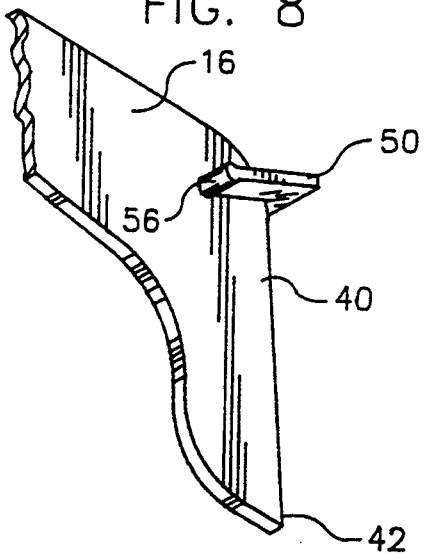
FIGS. 8 and 9 are perspective views showing alternative configurations of the transverse plate connected to the heel region of a bracket according to embodiments of the invention.

As depicted in FIG. 8, the heel region 40 of the bracket 16 is coupled to a plate 50. In the depicted embodiment, the plate 50 is positioned transversely to the planar bracket 16 and preferably in a plane approximately orthogonal to the plane of the bracket 16. The transverse plate 50 is preferably attached in a predetermined angular relationship to the bracket 16. As best seen in FIG. 2C, the angular relationship is such that when the bracket 16 is in the locked position (described below) the angle of the plate can be defined by an imaginary plane passing through the line of contact 47 between the plate 50 and the rear wall 20 and the line of contact 49 between the plate 50 and the front wall 52. According to an embodiment of the invention, an imaginary plane 52, which substantially passes through these two lines of contact is disposed at an angle 56 with respect to the longitudinal axis 54 of the standard 12 less than 90°, such as between about 75° and 85°, preferably between about 80° and 85°, and most preferably about 83°.

Figure 9:
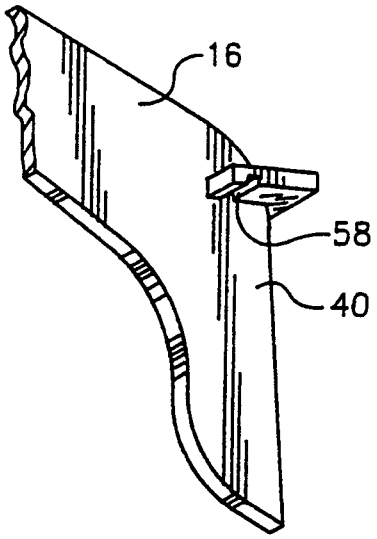

In one embodiment, the transverse plate 50 is formed separately from the body of the bracket 16, such as by stamping, and is connected thereto e.g., by press fitting into a slot formed in the heel region 40 of the bracket 16. If desired, the plate 50 can be provided with a configuration for engaging with the correspondingly-shaped heel slot such as a terminal bulb portion 56 or a lateral slot 58, as depicted in FIG. 9. Other shapes for engagement between the plate 50 and the bracket body 16 will be apparent to those skilled in the art. The plate 50 is preferably formed of the same material, as the bracket 16, e.g., steel, but can also be formed of other materials having the necessary strength, as will be apparent to those skilled in the art. The plate 50 can be coupled to the bracket 16 by means other than a press fit, such as by welding, brazing, pinning, key and slot arrangements, latching, crimping, bolting, screwing, and integral formation and/or bending although it is believed, that, in general, such alternative attachments are not as economic as a press fit.

Figure 6:
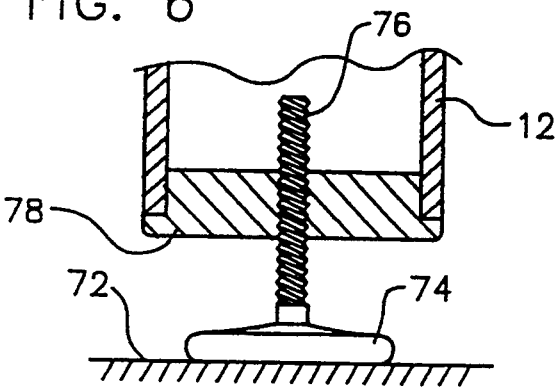
FIG. 6 depicts a foot arrangement for a standard according to one embodiment of the present invention.
Figure 7:
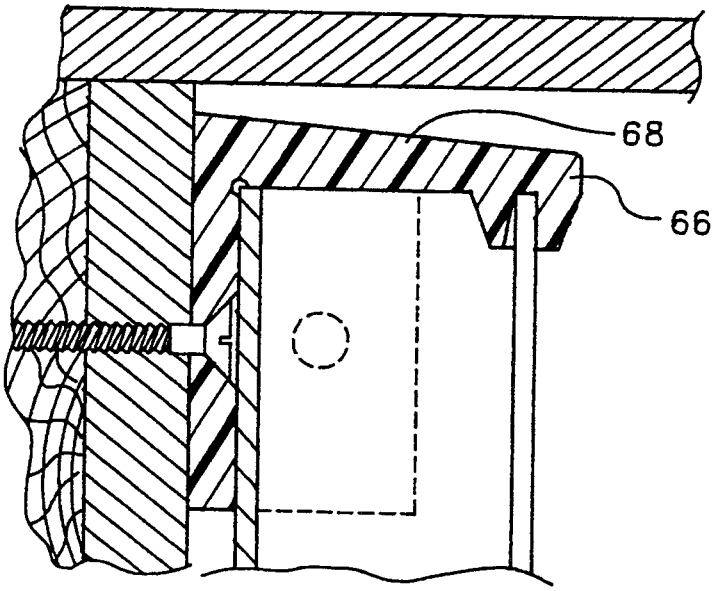
FIG. 7 is a vertical cross-section of a standard according to an embodiment of the present invention, showing a attachment and cap device.

The standard 12 can be attached to the wall 14 by a number of devices and methods. As depicted in FIG. 4, a U-shaped holding apparatus 60 can be screwed or bolted to the wall 14 and the standard 12 can be accommodated in the opening of the attachment device 60 and coupled thereto e.g., by set screws 62*a*, 62*b*. This type of arrangement provides the advantage that the standard 12 can be produced as a fungible slotted steel tube without the need for modifying to accommodate attachment devices, (such as by providing screw holes and the like). Furthermore, the attachment devices 60 can be easily provided with decorative and aesthetically pleasing exterior surfaces. Additionally, by using attachment devices 60, the interior surfaces of the standard 12 are maintained smooth and even for accommodating the plate 50 at any desired height, as described more fully below. The upper end 64 of the standard 12 can be held by a cup-shaped attachment device 66, as depicted in FIG. 7 which also provides a cap 68 for the standard 12. Alternatively, a separate cap 70 (FIG. 2) can be provided which fits as a plug in the upper end of the standard 12. As depicted in FIG. 1, the attachment devices 60 can be positioned at each end of a standard. Alternatively, the lower end of one or more standards 12 can be supported on a surface 72 (FIG. 6) by a foot 74, preferably with a screw height adjustment 76 passing through a bottom plate 78.

Figure 5:
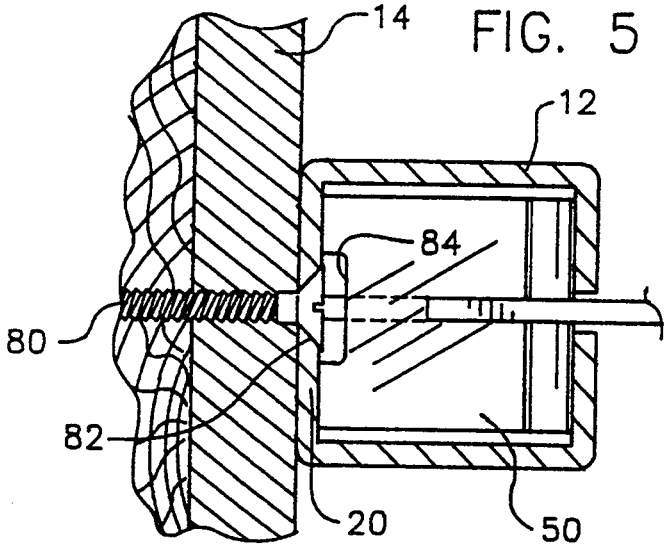
FIG. 5 is a cross-sectional view generally corresponding to the view of FIG. 4, but showing an alternative attachment configuration.

In yet another configuration, As depicted in FIG. 5, the standard 12 can be directly attached to a wall 14 by a known attachment device such as a screw 80, accommodated in a screw hole 82 formed in the back of the wall 20 of the standard 12. Preferably, the screw 80 is countersunk in a beveled screw hole so as not to interfere with positioning of the plate 50. Alternatively, the plate 50 may be provided with a cutout region 84 to permit passage over or around a screw head.

Figure 2B:
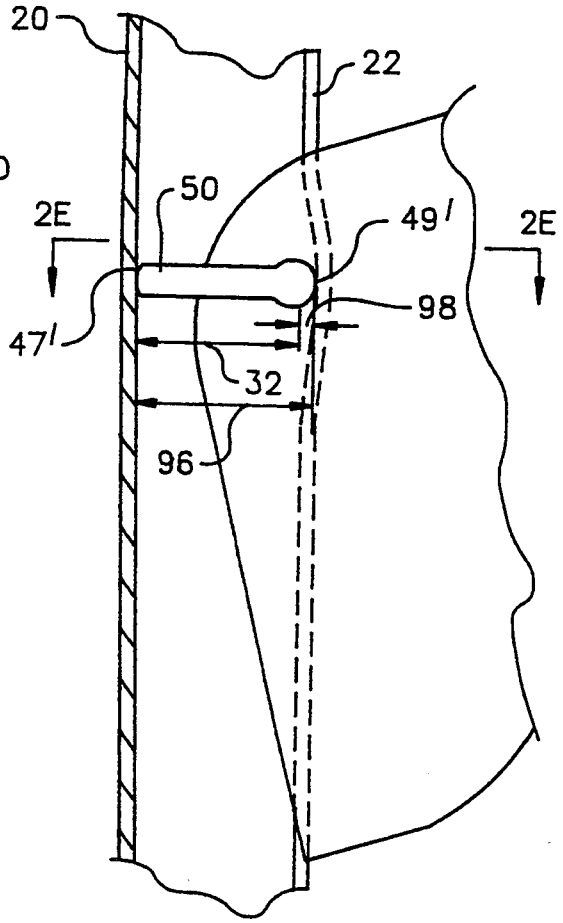
Figure 2D:
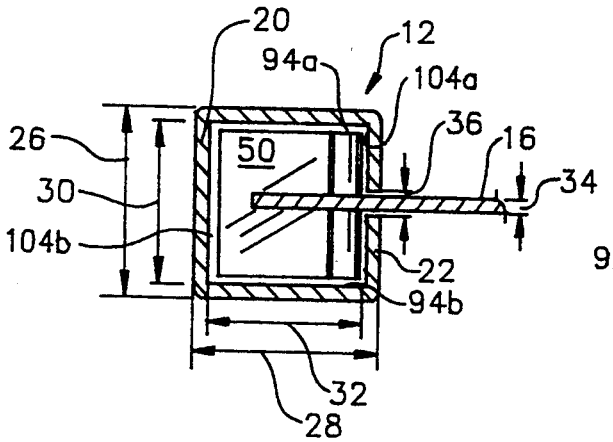
FIG. 2D, 2E and 2F are cross-sectional view taken along lines 2D—2D, 2E—2E, 2F—2F, of FIGS. 2A, 2B and 2C, respectively.
Figure 2E:
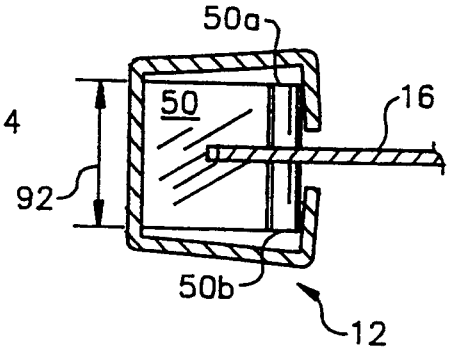
Figure 2C:
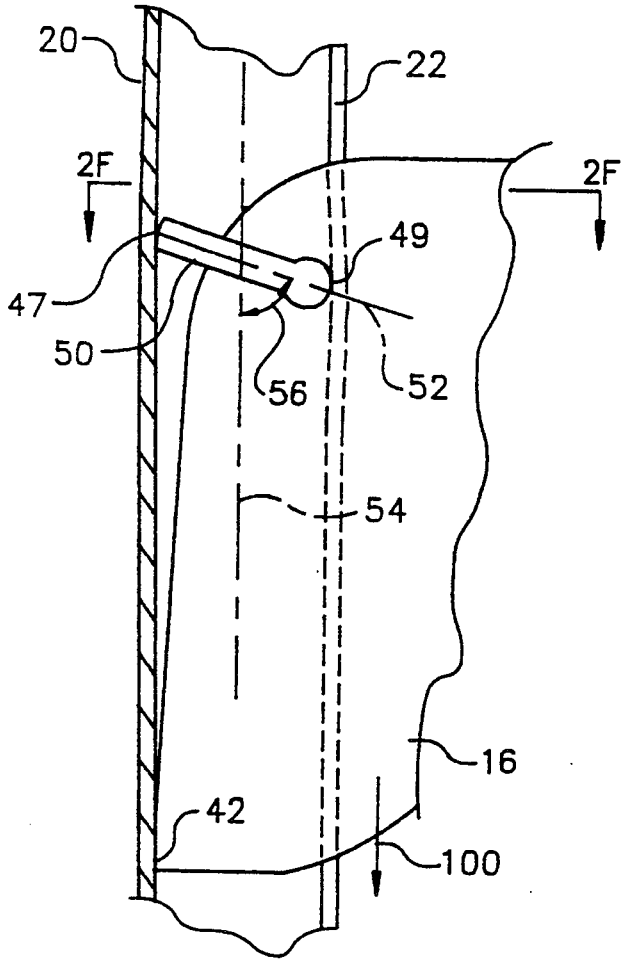

In the embodiment depicted in FIGS. 2E and 2B, the plate 50 has a cross-sectional shape such that the side edges 50*a*, 50*b* of the plate 50 can be positioned substantially adjacent and parallel to, although preferably slightly spaced from, the interior surfaces of the standard 12. In the embodiment depicted in FIGS. 2A–2F, the cross-sectional interior area of the standard 12 is substantially square or rectangular and the cross-sectional shape of the plate 50 is similar, i.e., also substantially square or rectangular. Other shapes can also be used. In one embodiment, the effective width 92 (FIG. 2E) of the rear edge of the plate 50 (i.e., the width between the most widely spaced points of the plate 50 which contact the rear wall 20 of the standard 12) is approximately 9/16 in. (about 15 mm), thus leaving a slight lateral space 94*a*, 94*b* (FIG. 2D) between the side edges 50*a*, 50*b* of the plate 50 and the adjacent walls of the standard 12.

The plate 50 also has a length 96. The length 96 can be defined with respect to the walls of the standard 12 when the plate 50 has placed the walls in the maximum stressed condition depicted in FIG. 2B. The plate length 96 is the distance along an imaginary plane orthogonal to the longitudinal axis 54 of the standard 12 between a line which is the projection on said imaginary plane of the line of contact 47' between the plate 50 and the rear wall 20 of the standard and the projection of the line of contact 49' between the plate 50 and the front wall 22. In rough terms, when the plate 50 is a substantially planar element, the length 96 is roughly equal to the dimension of the plate 50 measured along the plane of the planar plate in a direction parallel to the plane of the bracket 16. The length 96 of the plate 50 is a predetermined amount 98 greater than the interior depth 32 of the unstressed standard. In other words, the length 96 of the plate 50 exceeds the depth 32 of the unstressed standard by an amount 98. The plate is long enough to provide the desired support substantially from friction between the plate and the standard wall. Specifically, the difference in length 98 is large enough that when the bracket is configured in the locked position (FIG. 2C) the force from the elastically deformed standard 22 which compresses the plate between the front wall 22 and the rear wall 20 creates sufficient friction between the plate 50 and the front and rear walls 20, 22, combined with the friction of the heel bottom 42 on the rear wall 20 that the bracket 16 can support a desired amount of downward force 100 (such as from mass loading on the bracket 16) to maintain the bracket 16 in its position with respect to the standard 12 substantially solely in response to friction forces. The difference in length 98 is sufficiently small that the compressive force of the standard 12 on the plate 50 is not high enough to cause substantial plastic deformation of the standard walls 20, 22 or plate 50 or to cause punch-through or rupture of the standard wall, for the strength and hardness of the materials of which the standard 12 and plate 50 are made. In one embodiment, the distance 98 is greater than about 0.006 inches (about 0.15 mm), preferably between about 0.008 and about 0.012 inches (between about 0.2 mm and about 0.3 mm), most preferably about 0.01 inches (about 0.25 mm).

In use, a procedure for coupling a bracket 16 to the standard 12 at its desired height begins with inserting the plate 50 and a part of the heel portion through the upper opening 102 of a standard. Because the length of the plate 50 exceeds the depth of the standard 12, the plate 50 (and attached bracket 16) must be tilted 16' as shown by the phantom lines in FIG. 2. The bracket in this configuration is then moved to the desired height. In this configuration, as depicted in FIG. 2A, the plate 50 can be spaced 104*a*, 104*b* from the front and rear surfaces 22, 20 of the standard 12 with the arm 44 of the bracket extending through the slot 24 and outward from the standard 12. When the bracket 16 has been placed at the desired position at the standard 12, the bracket is pivoted from the angled configuration 16' to a locked configuration 16 (FIG. 2). This may be done by a user grasping the arm portion of the bracket 16 and pulling the bracket towards the desired configuration. Alternatively, a tool may be used for grasping and/or moving the bracket. The locking procedure is depicted in greater detail in FIGS. 2A–2F. As noted previously, the procedure begins with the plate 50 spaced 104*a*, 104*b* from the front and rear walls 22, 20 of the standard 12.

As the bracket 16 is moved toward the locked configuration, the front edge of the plate 50 will contact the interior surface of the front wall 22 of the standard and the rear edge of the plate 50 will contact the interior surface of the rear wall of the standard 12. At this point, no further movement of the bracket 16 towards the final configuration is possible without deformation. Although some minor deformation of the plate 50 may be experienced, the major deformation is deformation of a portion of the walls of the standard 12 as best seen in FIGS. 2B and 2E. The deformation depicted in FIGS. 2B and 2E is exaggerated for clarity. The deformation of the walls of the standard 12 is an elastic deformation. Plastic deformation, such as would be involved with gouging the interior surface of the walls is substantially avoided. Although there may be minor plastic deformation, such deformation, if it exists, is insubstantial, i.e., is sufficiently slight that it does not noticeably detract from the appearance or continuous adjustability of the device.

Rotation of the plate 50 and bracket 16 continues to the point of maximum deformation in which the full length 96 of the plate 50 is accommodated by a deformation equal to the difference in distance 98 between the plate length 96 and the undeformed standard interior depth 32. In the case of a substantially planar plate, this point occurs approximately when the plane of the planar plate 50 is substantially orthogonal to the longitudinal axis 54 of the standard 12.

Figure 2F:
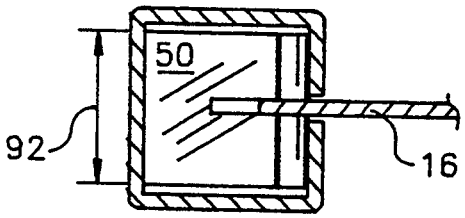
Figure 3:
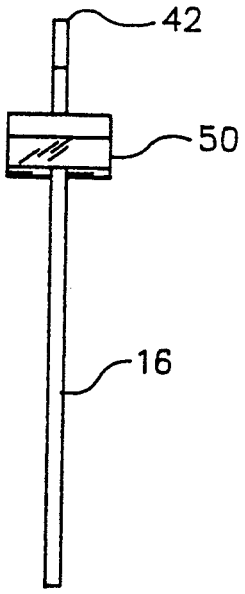
FIG. 3 is a top plan view of a bracket according to an embodiment of the present invention.

Further movement of the bracket 16 brings the plate 50 towards an angled configuration 56, permitting some (but preferably not total) relaxation of the elastically deformed standard 12. Rotation continues until a rotation stop engages. In the depicted embodiment, the rotation stop is formed by the bottom region of the heel 42 which contacts the rear wall 20 of the standard 12. Because the greatest force on the plate occurs at the maximum deformation configuration (FIG. 2B), the system tends to resist any movement toward this configuration and urge movement away from this configuration so that positioning to the configuration depicted in FIG. 2C involves an over-center scheme. In practice, as the user moves the bracket through the maximum deformation configuration (FIG. 2B) and into the locked configuration (FIG. 2C) the user feels a "snap" type tactile feedback. This provides a number of advantages. It assures the user that the bracket has been properly locked into position. It also assures that the amount of compression, and thus, the degree of friction which is provided, is a predetermined and reproducible amount. The reproducible amount is achieved because the stop action of the heel bottom 42 places the plate 50 in a predetermined angular configuration and thus provides a predetermined amount of elastic deformation of the standard, in turn providing a predetermined amount of compression on the plate. At this point, there will be some small elastic deformation of the standard 12 although it will be less than the maximum deformation 98, depicted in FIG. 2B. In the configuration depicted in FIG. 2C, the plate 50 contacts and is compressed between the front wall 22 and rear wall 20 of the standard 12. There is a minor amount of force of the heel bottom 42 on the rear wall 20. However, substantially all of the compressive force of the walls 22, 20 of the standard is borne by the plate 50 and there is substantially no compression of a portion of the bracket 16 between the walls 22, 20 of the standard 12. As depicted in FIG. 2F, when the bracket 16 is in the locked position, the effective width 92 of the rear edge of the plate 50 is greater than the thickness 34 of the bracket 16.

Figure 10:
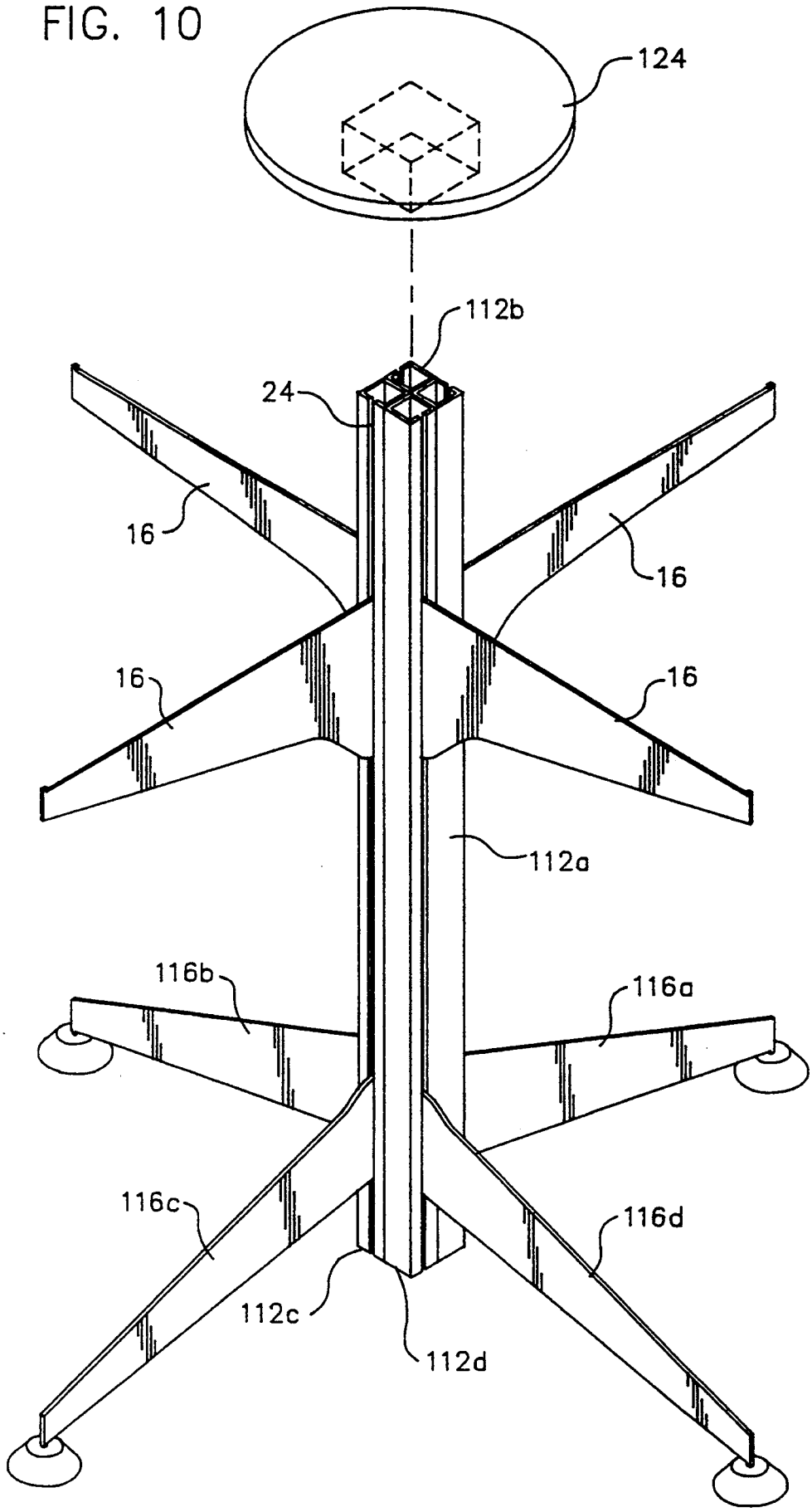
FIG. 10 is a perspective view, partially-exploded, of a free-standing standard and bracket system according to an embodiment of the present invention.
Figure 11:
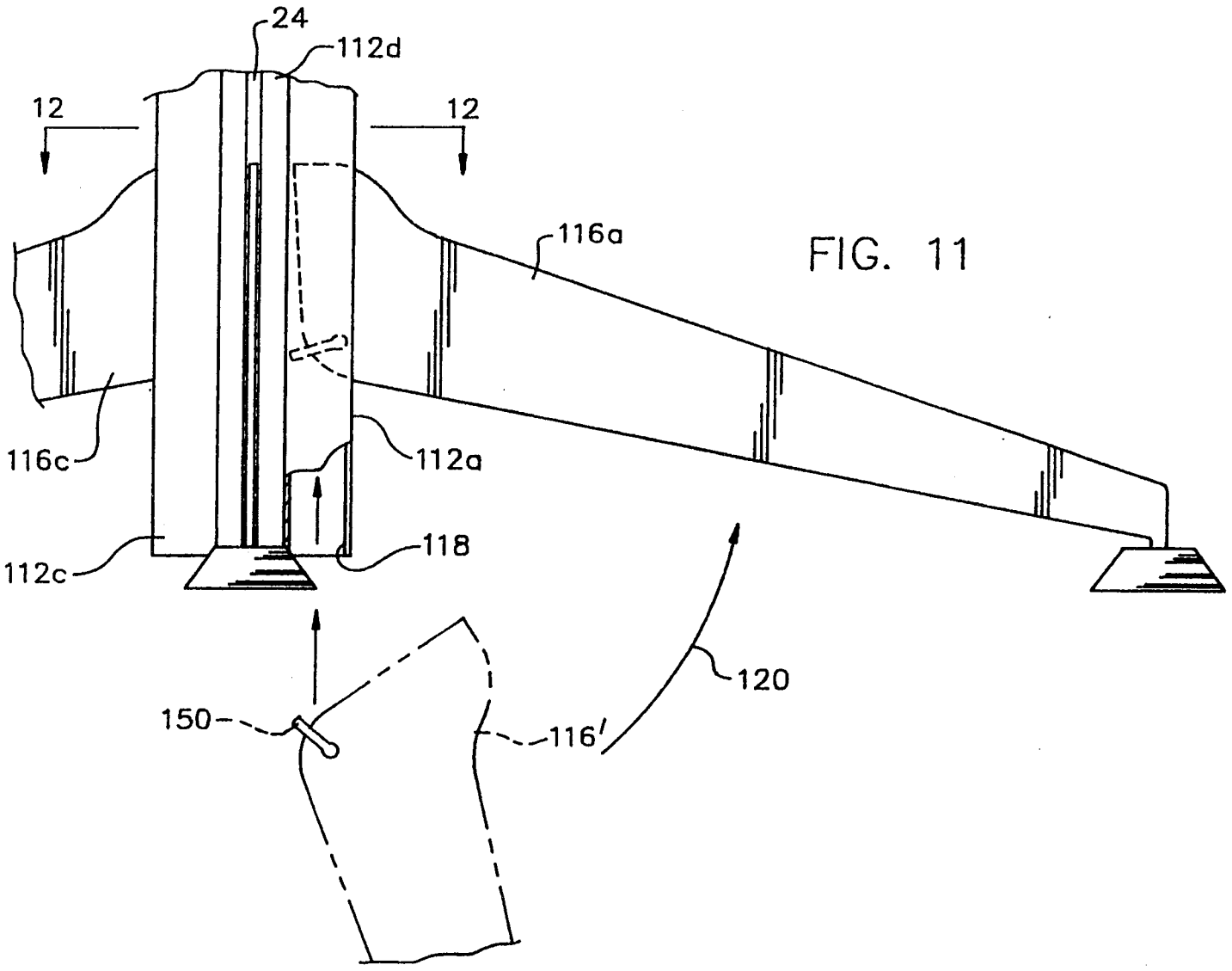
FIG. 11 is a plan view of a portion of the free-standing standard and bracket system according to another embodiment of the present invention, showing a foot bracket prior to insertion, in phantom.
Figure 14:
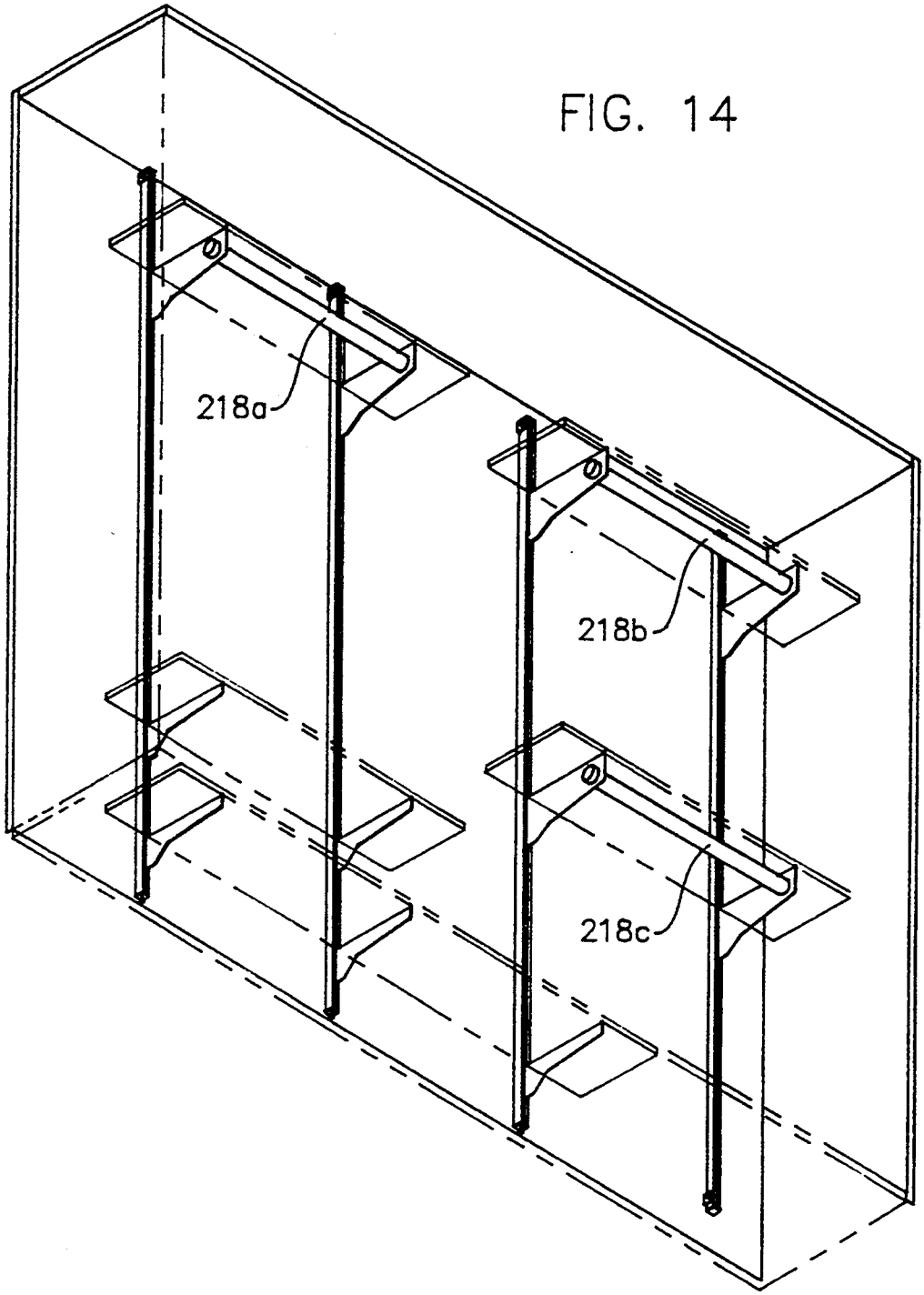
FIG. 14 is a perspective view showing a bracket and standard system for supporting shelving and clothes hanging bars in a closet according to an embodiment of the invention.

FIG. 10 depicts another embodiment of the present invention. According to FIG. 10, one or more standards are positioned in a free-standing configuration, i.e., without direct attachment to a wall. The free-standing configuration can be used to support items other than the brackets 16, such as a table top 124. The standards 112*a*, 112*b*, 112*c*, 112*d* are maintained in the desired free-standing position, preferably by one or more legs 116*a*, 116*b*, 116*c*, 116*d*. As depicted in FIG. 11, the legs 116*a*, 116*b*, 116*c*, 116*d* can be coupled to the standards 112*a*, 112*b*, 112*c*, 112*d* in a manner substantially similar to the coupling of the brackets 16 to the standards 112*a*, 112*b*, 112*c*, 112*d*. In particular, the legs 116*a*, 116*c* can be provided with a heel region having a transverse plate 150 that inserted through a bottom opening 118 of one of the standards 112*a* and pivoted 120 to a locked position 116*a*. The apparatus of FIG. 10 can be "knocked-down" by removing the legs 116 and arms 16 to provide a compact package of components, e.g., for shipping. In this way, a compact shipping package for a support/display system can be provided which is smaller than the "footprint" of the assembled device.

Figure 12:
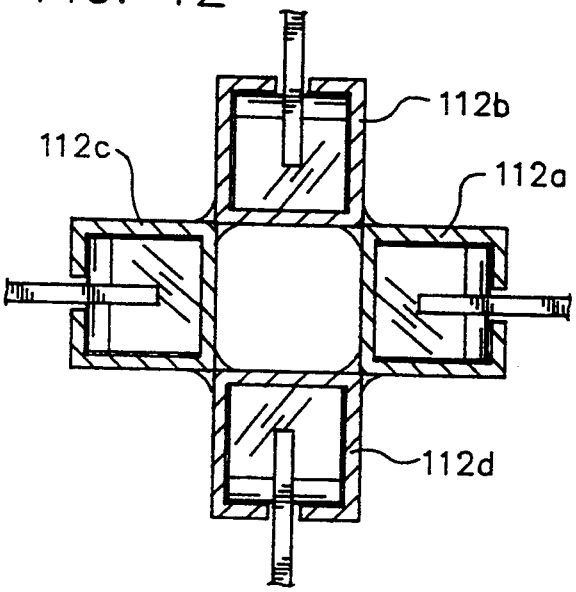
FIG. 12 is a cross-sectional view taken through line 12—12 of FIG. 11.
Figure 13:
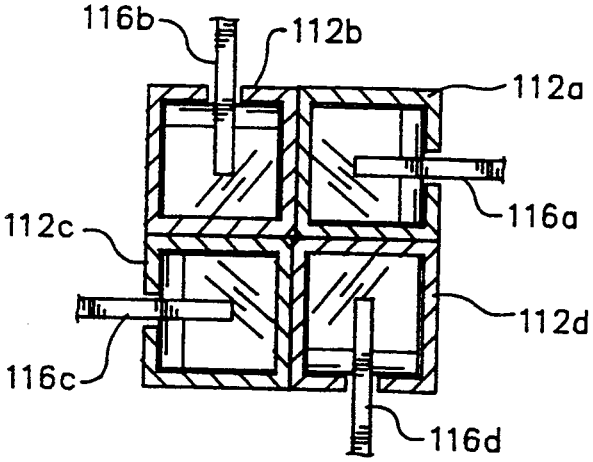
FIG. 13 is a cross-sectional view similar to the view of FIG. 12 but showing an alternative embodiment.

As depicted in FIG. 12, a plurality of standards 112*a*–112*d* can be connected to each other such as by welding, brazing, bolting, clamping, adhesives or the like. A number of configurations of the plurality of standards is possible, including the square pinwheel configuration depicted in FIG. 13 or a cruciform configuration depicted in FIG. 12.

In addition to the shelf support system depicted in FIG. 1, the present invention has a number of other uses, including supporting bars such as clothes hanging bars 218*a*, 218*b*, 218*c*.

Figure 15:
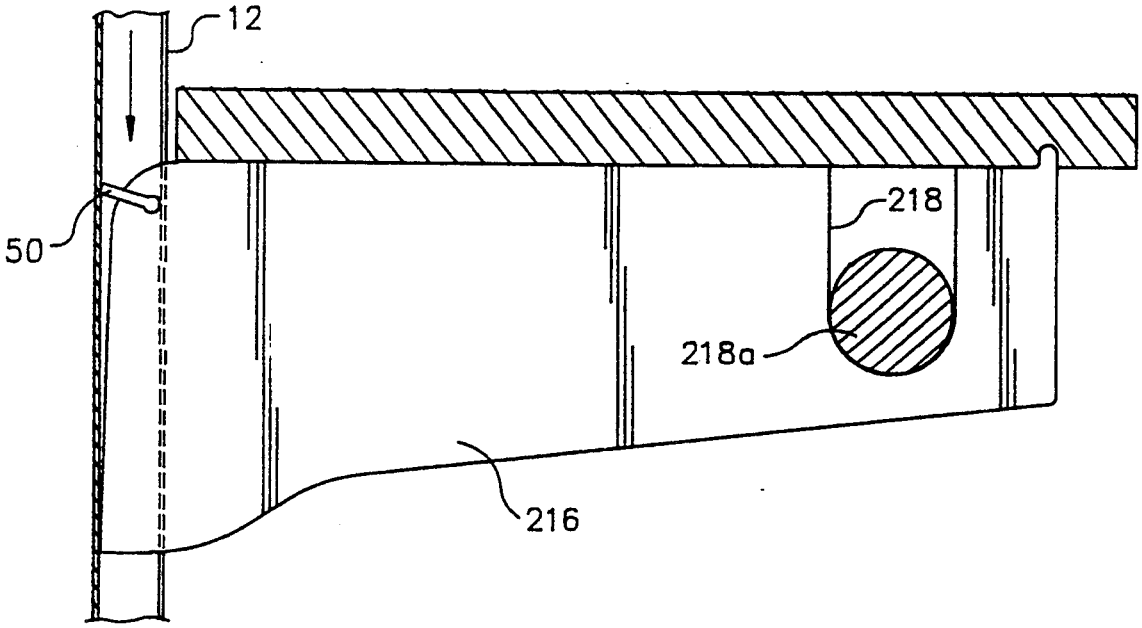
FIG. 15 is a partial cross-sectional view of a standard and bracket system for supporting a clothes hanging and shelf device according to an embodiment of the present invention.

As depicted in FIG. 15, a bracket 216 can be provided with a recess 218 for accommodating a bar 218*a* such as a clothes hanging bar. Such a bracket can be configured to engage with a standard 12 in a manner similar to that described above.

Figure 16:
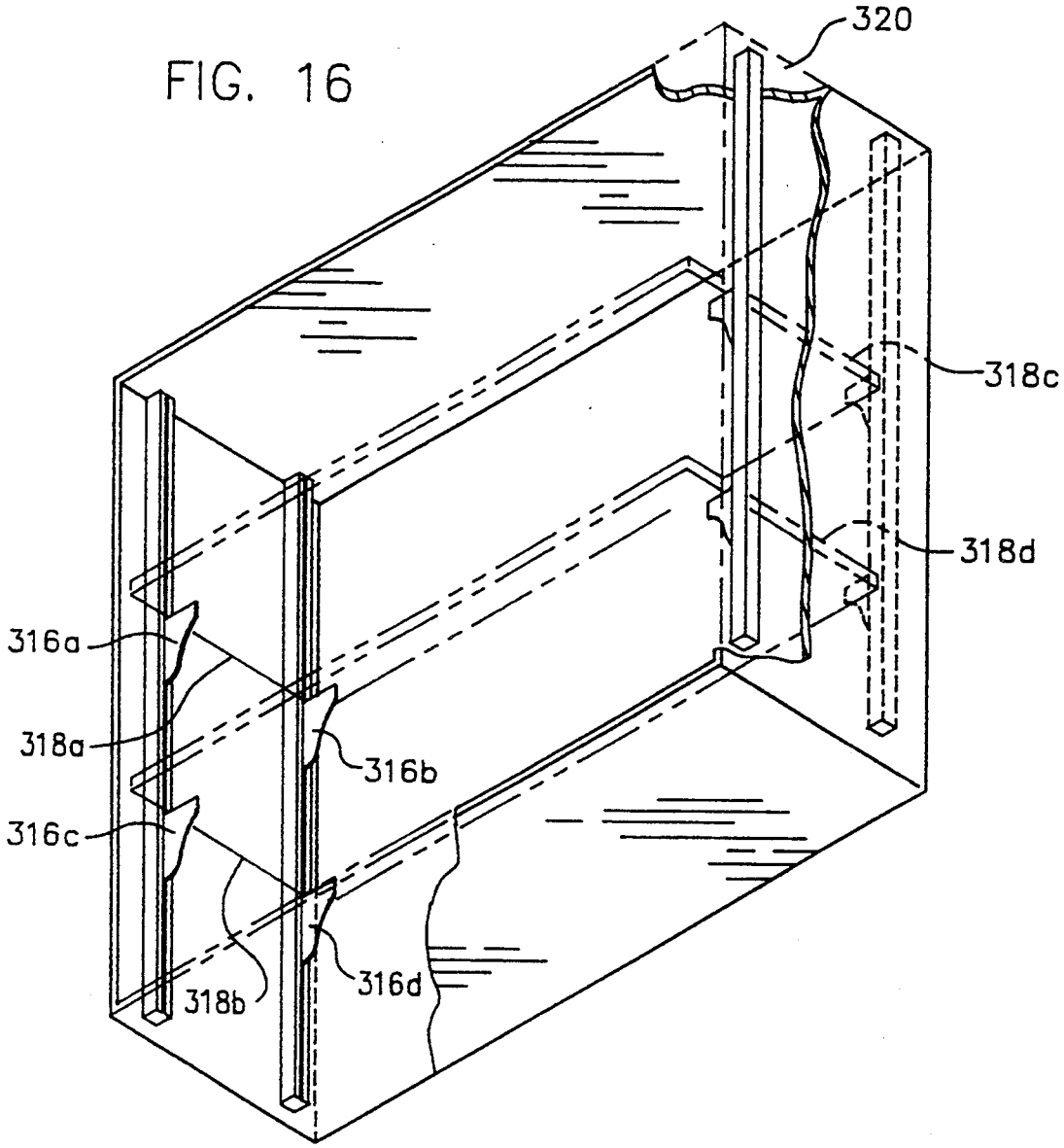
FIG. 16 is a perspective view depicting a standard and bracket system for end support of shelving in a cabinet according to an embodiment of the present invention.

As depicted in FIG. 16, the standard and bracket system of the present invention can be used for supporting shelves at their ends 318*a*, 318*b*, 318*c*, 318*d*, such as in the interior of a cabinet 320. As seen in FIG. 16, the support brackets 316*a*, 316*b*, 316*c*, 315*d* can be provided with relatively short arms. In this configuration, it may be necessary to use an extension tool, fitting over the bracket arm, in order to achieve sufficient torque to pivot the shortened brackets 13*a*–13*d* into the locked configuration.

Figure 17:
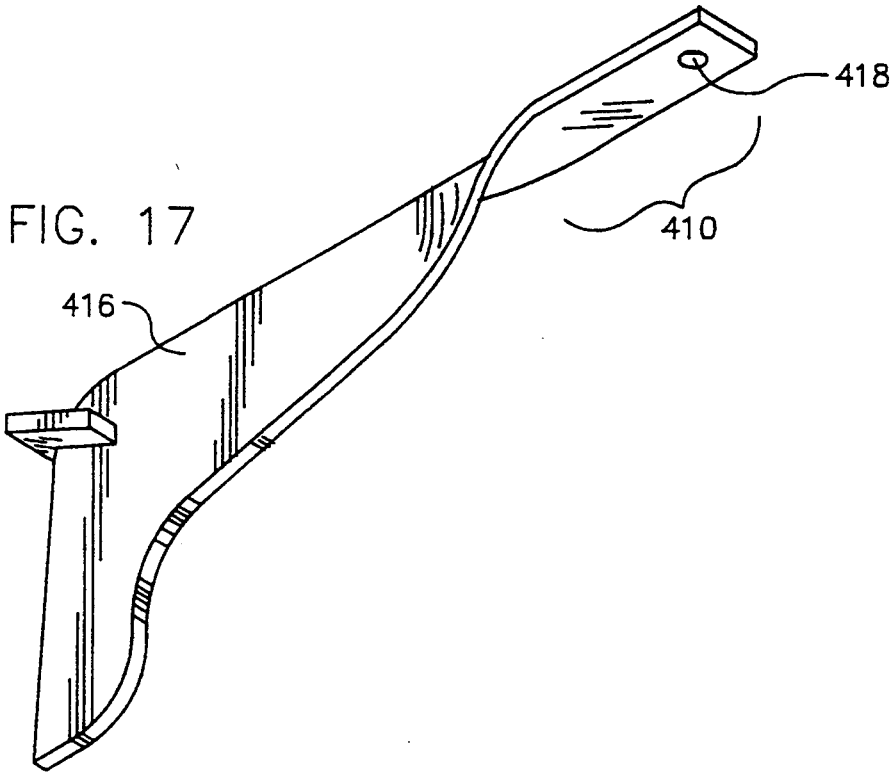
FIG. 17 is a perspective view of a standard with the tip portion twisted to accommodate a vertical screw hole.

As depicted in FIG. 17, when it is desired to permit screw attachment of a bracket to a shelf, the tip 410 of the bracket body 416 can be twisted 90° to provide a screw hole 418 which would have an axis orthogonal to the plane of the shelf supported by the bracket 416.

In light of the above description, a number of advantages of the present invention can be seen. The present invention provides a support system in which brackets can be locked in continuously-selectable (rather than discrete) locations along the length of the standard to provide for infinite adjustability, i.e., adjustment to an infinite number of positions. The present invention provides this capability in a fashion that is economically feasible. Among the items contributing to the economic feasibility of the present invention are the ability to use a thin bracket which can be produced by a stamping process, the ability to attach a transverse plate by a press fit method, and the ability to use commonly available slotted steel tubes for the standard portions. The present invention provides for an attractive and long-lived apparatus by avoiding gouging or plastic deformation of components. The present invention avoids punch-through or other externally visible deformation of the standards. The present invention provides for positive locking with a tactile feedback. The present invention provides a desired load-bearing ability arising substantially solely from the frictional forces and without substantial plastic deformation of the apparatus.

A number of variations and modifications of the invention can also be used. The support system can also be used for supporting items other than shelving, rods and the like, including supporting items for display, supporting signs or pictures, supporting lighting fixtures, and the like. The bracket in the locked position may provide an arm which is other than horizontal such as being angled upwardly or downwardly. The present invention can be used in connection with standards which have shapes other than a square or rectangular shape such as those having a triangular or circular cross-section (with corresponding modifications of the plate shape). The present invention can provide standards in which the slot is not straight, for example in which the slot is inclined or spiral-shaped. The present invention can provide the standard in two or more pieces which can be connected together. The present invention can provide for standards with two or more slots. The standards can have a non-straight longitudinal axis such as being curved. The present invention can include openings to permit insertion of the plate into the standard at points other than the top or bottom of the standard. The present invention can provide for transverse structures attached to the bracket other than planar-shaped plates, including square or triangular cross-section bars large enough to contact both of two opposed surfaces. The plate can be non-symmetrical with respect to the bracket plane. The bracket can be provided with additional modifications for accommodating attachment to other devices such as holes, dimples, threaded holes, hooks, buckles and the like. The bracket can be provided with one or more hinged sections so that portions of the bracket can be swung away if desired. The standard can be positioned in a configuration other than vertical such as angled or horizontal.

Although the present invention has been described by way of a preferred embodiment and certain variations and modifications, other variations and modifications can also be used, the invention being defined by the following claims.

What is claimed is:

1. Support apparatus usable for supporting shelving, comprising:

an elongated standard with a hollow interior region, said standard having a front wall portion with at least a first slot and a back wall portion, said slot having a longitudinal extent and a width, a bracket having an arm portion and a heel portion, positionable partially within said standard, with at least a part of said arm portion extending through said slot and outward from said standard, said bracket having a thickness;

a transverse plate coupled to said heel portion of said bracket and positionable within said standard, said plate having a front edge and a rear edge, said rear edge having an effective width;

said bracket being movable from a first angular configuration with respect to said standard, wherein said bracket can slide longitudinally along said slot, to a second configuration wherein said transverse plate is compressed between said front wall portion and said back wall portion, providing resistance to longitudinal sliding along said slot, at least portions of said rear edge of said transverse plate contacting said back wall when said bracket is in said second position, in the absence of substantial plastic deformation of said elongated standard, said effective width of said rear edge being greater than the thickness of said bracket, wherein said front edge is at a lower longitudinal position than said rear edge when said bracket is in said second position.

2. Apparatus, as claimed in claim 1, wherein said effective width of said rear edge is substantially the same as the width of said interior region of said standard.

3. Apparatus, as claimed in claim 1, wherein said standard includes first and second sidewall portions, substantially opposed to each other, and wherein, when said bracket is in said second position, said plate contacts said front wall and said back wall and at least portions of said transverse plate are adjacent each of said sidewall portions.

4. Apparatus, as claimed in claim 1, wherein said standard comprises steel.

5. Apparatus, as claimed in claim 1, wherein when said bracket is in said second configuration, said plate contacts said back wall portion at a first longitudinal position and said bracket contacts said back wall at a second longitudinal position spaced from said first longitudinal position.

6. Apparatus, as claimed in claim 1, further comprising means for attaching said standard to a wall.

7. Support apparatus usable for supporting shelving, comprising:

an elongated standard having a front wall portion with at least a first elongated slot and a back wall portion, a bracket having an arm portion and a heel portion, positioned partially within said standard, with a portion extending through said slot and at least part of said arm portion extending outward from said standard, said bracket having a thickness.

a transverse plate coupled to said heel portion of said bracket and positioned within said standard said plate having a front edge and a rear edge, said rear edge having an effective width greater than the thickness of said bracket;

said bracket being movable from a first angular configuration with respect to said standard, wherein said bracket can slide longitudinally along said slot, to a second configuration wherein said transverse plate is compressed between said front wall portion and said back wall portion to resist longitudinal sliding along said slot, in the absence of substantial compression of said bracket, between said front wall portion and said back wall portion in the absence of substantial plastic deformation of said elongated standard;

wherein in said second configuration said front edge of said plate is at a lower longitudinal position than said rear edge of said plate.

8. Support apparatus usable for supporting shelving, comprising:

an elongated standard having a longitudinal axis, said standard having a front wall portion with at least a first elongated slot and a back wall portion, a bracket having an arm portion and a heel portion, positioned partially within said standard, with a portion extending through said slot and at least part of said arm portion extending outward from said standard, said bracket having a thickness, a transverse plate, lying substantially along a plane, coupled to said heel portion of said bracket and positioned within said standard, said plate having a front edge and a rear edge, said rear edge having an effective width greater than the thickness of said bracket;

said bracket being movable from a first angular configuration with respect to said standard, wherein said bracket can slide longitudinally along said slot, to a second configuration wherein said transverse plate is compressed between said front wall portion and said back wall portion to resist longitudinal sliding along said slot in the absence of substantial plastic deformation of said elongated standard;

wherein, when said bracket is in said second configuration, said plane forms a first angle with said longitudinal axis said angle being between about 75° and 85°, said front edge being at a lower longitudinal position than said rear edge.

9. Support apparatus usable for supporting shelving, comprising:

an elongated standard having a longitudinal axis, said standard having a front wall portion with at least a first elongated slot and a back wall portion, each of said front wall and said back wall having an interior surface and an exterior surface, said interior surface of said back wall portion being spaced a first distance from said interior surface of said front wall portion over at least a first longitudinal extent of said standard when said standard is in an unstressed state;

a bracket having an arm portion and a heel portion, positioned partially within said standard, with a portion extending through said slot and at least part of said arm portion extending outward from said standard, said bracket having a thickness, a transverse plate coupled to said heel portion of said bracket and positioned within said standard, said transverse plate having a front edge and a rear edge and having a first length from said front edge to said rear edge, said rear edge having an effective width greater than the thickness of said bracket;

said bracket being movable from a first angular configuration with respect to said standard, wherein said bracket can slide longitudinally along said slot, to a second configuration wherein said transverse plate is compressed between said front wall portion and said back wall portion to resist longitudinal sliding along said slot in the absence of substantial plastic deformation of said elongated standard, said front edge being at a lower longitudinal position than said rear edge;

said first length of said longitudinal plate being at least 0.010 inches greater than said first distance from said front wall to said back wall.

10. Apparatus, as claimed in claim 9, wherein said first length is at least 0.008 inches greater than said first distance.

11. Apparatus, as claimed in claim 9, wherein said first length is at least 0.01 inches greater than said first distance.

12. A bracket, usable with a slotted standard, having an interior depth, for supporting a shelf, comprising:

a substantially planar member having a first shelf support region and a heel portion configured to fit in the interior of the slotted standard, said planar member having a thickness;

a locking member, having a first dimension, parallel to the longitudinal axis of said planar member, greater than said interior depth of the standard, and coupled to said heel portion to extend outward from the plane of said planar member said locking member having a front edge and a rear edge, said rear edge having an effective width greater than the thickness of said planar member;

wherein said front edge, when installed, is located at a lower distance on said slotted standard than said rear edge.

13. Apparatus for positioning a support arm comprising:

an elongated hollow member having at least a first slot;

a bracket having a first portion positionable in said hollow member such that a second portion extends through said slot, outward from said elongated hollow member, said second portion having a thickness; and means, coupled to said bracket, for locking said bracket in a desired location along said hollow member, by compressing said means between opposed surfaces of said elongated hollow member, in the absence of substantial plastic deformation of said elongated hollow member;

wherein said means for locking comprises a flat plate coupled to said first portion of said bracket, said plate having a front edge and a rear edge, said front edge being lower than said rear edge when said bracket is locked by said means for locking, said rear edge having an effective width greater than the thickness of said second portion.

14. A method for positioning a support arm, comprising:

providing a standard having opposed first and second walls and at least a first slot in said first wall;

providing a bracket having an arm portion and a heel portion, with a transverse plate coupled to said heel portion, said arm portion having a thickness, said transverse plate having a front edge and a rear edge, said rear edge having an effective width greater than the thickness of said arm portion;

inserting said transverse plate and at least part of said heel portion into said standard;

positioning said transverse plate at a first angle such that said plate clears said first and second walls;

moving said bracket to a desired location along said standard;

positioning said plate at a second angle so that said plate is angled downward in a direction towards said first wall, wherein said plate contacts and is compressed between said first and second walls, in the absence of substantial plastic deformation of said first and second walls.

15. A method for positioning a support arm, comprising:

providing a standard having opposed first and second walls and at least a first slot;

providing a bracket having an arm portion and a heel portion, with a transverse plate coupled to said heel portion, said arm portion having a thickness, said transverse plate having a front edge and a rear edge, said rear edge having an effective width greater than the thickness of said arm portion;

inserting said transverse plate and at least part of said heel portion into said standard;

positioning said transverse plate at a first angle such that said plate clears said first and second walls;

moving said bracket to a desired location along said standard;

positioning said plate at a second angle so that said plate contacts said first and second walls, elastically deforming said walls by a first distance, said second angle being near perpendicular to said first and second walls;

positioning said plate at a third angle so that said plate contacts said first and second walls, elastically deforming said walls by a second distance, less than said first distance in the absence of substantial plastic deformation of said standard;

wherein, at said third angle, said front edge is at a lower longitudinal position than said rear edge.

16. A method, as claimed in claim 15, wherein said step of positioning said plate at a third angle further comprises providing tactile feedback to a user.

17. A method, as claimed in claim 15, wherein one of said first and second walls is a back wall and wherein said plate contacts said back wall along a line and wherein said step of positioning said plate at a third angle comprises pivoting said plate substantially about said line.

18. Support apparatus usable for supporting shelving, comprising:

an elongated standard with a hollow interior region, said standard having a front wall portion with at least a first slot and a back wall portion, said slot having a longitudinal extent and a width, a bracket having an arm portion and a heel portion, positionable partially within said standard, with at least a part of said arm portion extending through said slot and outward from said standard, said bracket having a thickness;

a transverse plate having a front edge and a rear edge, said rear edge having an effective width, said transverse plate formed separately from said bracket, said transverse plate coupled to said heel portion of said bracket and positionable within said standard;

said bracket being movable from a first angular configuration with respect to said standard, wherein said bracket can slide longitudinally along said slot, to a second configuration wherein said transverse plate is compressed between said front wall portion and said back wall portion, providing resistance to longitudinal sliding along said slot, at least portions of said rear edge of said transverse plate contacting said back wall when said bracket is in said second position, said effective width of said rear edge being greater than the thickness of said bracket; and wherein when said bracket is in said second position said front edge is at a lower longitudinal position than said rear edge.

19. Apparatus for positioning a support arm comprising:

an elongated hollow member having at least a first slot;

a bracket having a first portion positionable in said hollow member such that a second portion extends through said slot, outward from said elongated hollow member, said second portion having a thickness; and means, coupled to said bracket, for locking said bracket in a desired location along said hollow member, by compressing said means between opposed surfaces of said elongated hollow member;

wherein said means for locking comprises a flat plate coupled to said first portion of said bracket, said plate formed separately from said bracket said plate having a front edge and a rear edge, said rear edge having an effective width greater than the thickness of said second portion; and wherein when said bracket is locked in said hollow support member by said means for locking, said front edge of said plate is lower than said rear edge of said plate.

20. A method for positioning a support arm, comprising:

providing a standard having opposed first and second walls and at least a first slot in said first wall;

providing a bracket having an arm portion and a heel portion, said arm portion having a thickness;

providing a transverse plate, said transverse plate having a front edge and a rear edge, said rear edge having an effective width greater than the thickness of said arm portion;

coupling said transverse plate to said heel portion of said bracket;

inserting said transverse plate and at least part of said heel portion into said standard;

positioning said transverse plate at a first angle such that said plate clears said first and second walls;

moving said bracket to a desired location along said standard;

positioning said plate at a second angle so that said plate contacts and is compressed between said first and second walls; and wherein said step of positioning said plate at a second angle comprises positioning said front edge of said plate at a lower longitudinal position than said rear edge.

* * * * *